US005347892A

United States Patent [19]

Moetteli

[11] Patent Number: 5,347,892

[45] Date of Patent: Sep. 20, 1994

[54] SOCKET RETAINER FOR THIN-WALL DRIVE MEMBER

[76] Inventor: John B. Moetteli, 15207 McConn, Webster, Tex. 77598

[21] Appl. No.: 29,709

[22] Filed: Mar. 11, 1993

[51] Int. Cl.[5] ..... B25B 13/06

[52] U.S. Cl. ..... 81/177.85; 81/124.2; 81/124.3; 81/125; 279/79

[58] Field of Search ..... 81/125, 177.85, 438, 81/124.3, 124.2, 185, 124.1, 121.1, 177.1, 180.1; 76/114; 403/329; 279/79-80

[56] References Cited

U.S. PATENT DOCUMENTS

| | | | |
|---|---|---|---|
| 125,695 | 4/1872 | Sanborn . | |
| 1,165,995 | 12/1915 | Mossberg . | |
| 1,347,691 | 7/1920 | Forton . | |
| 1,413,698 | 4/1922 | Adams . | |
| 1,433,163 | 10/1922 | Walters . | |
| 1,826,765 | 10/1931 | Gang | 76/114 |
| 2,300,479 | 11/1942 | Wilson . | |
| 2,317,461 | 4/1943 | Jackson . | |
| 2,549,515 | 4/1951 | Orey et al. . | |
| 2,727,418 | 12/1955 | Moon | 81/124.3 |
| 2,803,877 | 8/1957 | Belanger . | |
| 3,623,522 | 11/1971 | Lindberg | 81/438 |
| 4,328,720 | 5/1982 | Shiel . | |
| 4,520,697 | 6/1985 | Moetteli . | |
| 4,602,534 | 7/1986 | Moetteli | 81/125 |

FOREIGN PATENT DOCUMENTS

| | | | |
|---|---|---|---|
| 107741 | 6/1943 | Sweden | 81/125 |
| 230545 | 4/1944 | Switzerland | 81/125 |

*Primary Examiner*—Robert C. Watson
*Attorney, Agent, or Firm*—Da Vinci Design

[57] ABSTRACT

This invention relates to an improved socket retainer device for a thin-wall drive portion of a wrench having an inner and outer drive portion. A resilient spring is placed within an elongated slot which is machined in the drive portion of the wrench. The outer edge of the slot is deformed such that the resilient spring is held firmly in place at its ends, the middle portion of the resilient spring being allowed to deflect and frictionally engage sockets when the socket is attached to the drive portion of the wrench. One embodiment of the present invention defines an s-shaped resilient spring and another defines two opposed resilient springs. The design results in lower fabrication and assembly costs and improved socket retention ability without compromising the strength of the drive portion of the wrench.

18 Claims, 6 Drawing Sheets

SOCKET RETAINER FOR THIN-WALL DRIVE MEMBER

TECHNICAL FIELD

This invention relates generally to hand tools, and more particularly to wrenches for rotating a fastener.

BACKGROUND

Attempts have been made to eliminate the need for multiple length socket sets in ratchet wrench design without sacrificing structural integrity, reliability or ease of use. Early attempts focused on designs of ratchet wrenches having a hole through the wrench centered on the axis of rotation of the drive portion of the ratchet wrench. U.S. Pat. No. 125,695 to Sanborn, U.S. Pat. No. 1,165,995 to Mossberg and U.S. Pat. No. 2,317,461 all disclose a ratchet wrench with a through hole. The wrench in each of these patents is adapted for only a single fastener size. U.S. Pat. Nos. 1,347,691 to Forton, 4,328,720 to Shiel, and 2,300,479 to Wilson each discloses a ratchet wrench with a through hole which is adapted for using interchangeable sockets enabling the use of the wrench with a range of fastener sizes. U.S. Pat. Nos. 4,520,697 and 4,602,534 to Moetteli disclose a ratchet wrench having a through hole and which is adapted for use with multiple sockets. The later two patents to Moetteli disclose a reversible ratchet wrench which eliminates the need for multiple length socket sets through the use of special sockets which are comparable to the weight, compactness, strength and size range of standard square drive sockets. Though the latter two patents describe an invention which overcomes most of the disadvantages and shortcomings characteristic of the earlier through-hole designs, it is not successful in duplicating the retention force typical of a standard ratchet wrench's spring-and-ball detent without a concomitant sacrifice in structural integrity.

Proper retention of a socket is an important feature of wrenches because it prevents the inadvertent disengagement of the socket from the drive portion of the wrench. Inadvertent disengagement can result in extreme inconvenience for several reasons. First, the socket may become much more difficult to position over the fastener if it is not held in place on the drive and maneuvered by the operator's hand remotely through the ratchet wrench's handle. Second, the socket may become lost in some remote recess, or become temporarily unretrievable due to its becoming lodged in a recess near a very hot component of an automotive engine thus making safe retrieval difficult. Third, although the operator may be able to successfully remove the ratchet, the socket may remain on the fastener thereby becoming difficult or impossible to remove without expending excessive time to do so. Fourth, due to their additional weight, the ratchet may not be able to adequately retain commonly used accessories on the drive member such as a universal joint or extension; this will result in still more difficulty in accessing a fastener for removal or installation. Fifth, the socket may slip off the drive during wrenching with the possible result being damage to the ratchet or socket and/or injury to the operator.

In standard ratchet wrenches adapted for use with a socket set, it is common to provide a spring-and-ball detent to secure the socket on the drive member of the wrench during use. Generally, this has provided adequate retention such that the five problems mentioned above can be avoided. Characteristic of a spring-and-ball detent is the requirement of a relatively thick section on the drive member in order to accommodate the enclosure the spring and the ball. However, because a thin-wall is created in the drive portion when the wrench has a through hole and (1) has an inner and outer drive or (2) has a drive portion which protrudes beyond the drive member of the wrench, there is insufficient material to support this conventional means for retaining a socket on the drive.

U.S. Pat. No. 2,549,515 to Orey et al describes a thin-wall through-hole wrench that utilizes resilient members disposed within a key-way type recess in the thin-wall sleeve to restrain the sockets onto the sleeve or drive portion. These resilient members provide adequate retention of the sockets onto the sleeve; however, the resilient member and key-way recess retain a socket from one side of the drive portion only, not from both surfaces of the drive portion as provided in the present invention. Also, no means is described for the mounting of the resilient member onto the drive portion. In the invention as described in U.S. Pat. No. 4,328,720 to Shiel, the means provided for retaining a socket was that of a resilient annular wire disposed within the thin-wall portion of the drive member. This too may provide adequate retention of a socket, but it also requires that a recess be machined into the drive portion in which the wire may be disposed. This recess weakens the drive portion as it lies within a plane substantially perpendicular to the torsional axis of the wrench.

The hand tool described in U.S. Pat. No. 1,413,698 to Adams discloses a spring clip formed of a resilient strip of metal. This clip is designed to hold shanks or sockets within the drive portion. It would therefore be ineffective for retaining sockets either on the outside or the inside of the drive portion. In addition, the spring clip requires that a reduced thickness portion be machined or molded onto the thin-wall portion of the drive member. This reduced thickness portion compromises the structural integrity of the drive portion against torsional stresses induced through normal operation of the hand tool.

The swivel knife described in U.S. Patent No. 2,803,877 to Belanger discloses a V-shaped retainer spring for the purpose of retaining an internal tool shank and an outer collar. This retainer spring does not function independently but requires a cylindrical component referred to as a locking means in order to retain the tool shank inside the stud.

The ratchet wrenches described in U.S. Pat. Nos. 4,520,697 and 4,602,534 to Moetteli above recites incorporate several methods for retaining a socket to a drive member having a thin-wall drive portion. A first method incorporates a push-button release feature which allows the operator to remove a socket by depressing a resilient button or comparable element. A second method utilizes a resilient spring clip which snaps in place over the thin-wall portion of the drive member in a manner similar to a paper clip. However, the first method utilizes a spring which is relatively complicated and costly to produce and the second method utilizes a spring clip that requires that a reduced thickness portion be machined or molded onto the thin-wall portion of the drive member. Furthermore, this spring clip is unsatisfactory as it frequently breaks due to its thin cantilevered construction or fails to properly hold the socket in place due to a limitation in the amount of spring force and friction that can be generated when deflected. This limitation on spring force is due to the necessity that the spring clip be made of thin material in order to wrap around the reduced thickness portion while remaining flush with the outer and inner surfaces of the drive member in the area of the reduced thickness portion. The thicker the spring is, the thinner the reduced thickness portion must be and consequently, the weaker the structure of the drive member becomes. In addition, the reduced thickness portion is complicated, relatively costly to produce, and detrimental to the structural integrity of the drive member.

A need therefore exists for an improved socket retainer which can reduce manufacturing costs and increase the amount of frictional force with which to securely hold a socket on a through-hole wrench having an inner and outer drive portion without unduly diminishing the structural integrity of the wrench.

SUMMARY

My invention is directed to an improved retainer for a ratchet wrench having a thin-wall drive member that satisfies the needs identified above.

In accordance with one embodiment of the present invention, I have invented an improved ratchet wrench for rotating a fastener. The ratchet wrench includes a handle having a head at one end thereof, the head having a cylindrical aperture formed therethrough centered on an axis. A drive member is mounted onto the handle and extends into the cylindrical aperture for rotation about the axis relative to the handle. The drive member is operably connected to a fastener so that rotation of the drive member rotates the fastener. The drive member further defines another aperture extending therethrough along the axis. This drive member has a drive portion with inner and outer surfaces extending along a common axis, the outer surface of the drive portion having a non-circular cross section perpendicular to the common axis and adapted for receiving a socket, and the inner surface of the drive portion having a non-circular cross section perpendicular to the common axis and adapted for receiving a socket. An elongated slot is formed through the inner and outer surfaces of the drive member. This elongated slot has opposite ends and at least one internal flange portion formed adjacent to the internal surface within the elongated slot such that a projection is formed at each end of the elongated slot. A resilient s-shaped spring is disposed within the elongated slot and is held in place by deforming an edge against each end of the resilient spring. This edge is defined by the intersection of the outer surface and the elongated slot. This deforming operation effectively sandwiches the spring ends between the deformed edge and each projection while still allowing the middle portion of the spring to flex. Each wave of the s-shaped spring is sized to protrude beyond the elongated slot and either into the aperture or out of the drive member such that a socket will necessarily deflect the corresponding wave of the s-shaped spring when fully engaged on the drive. This deflection of the resilient spring enables the frictional retention of the socket on the drive member. Furthermore, the thickness of the spring is not limited in that it need not wrap around the drive member and therefore does not locally increase the width of the drive portion or create a structurally weak region in the drive portion as is evident when considering a cross section through the drive member in an area between the furthermost end of the elongated slot and the end of the drive portion (in this region, the drive portion remains of consistent thickness). In this embodiment, the thickness of the spring is limited by the thickness of the drive portion minus the sum of the thickness of the flange and the thickness of the deformed edge of the elongated slot (the thicker the spring, the stronger the socket retention force of the spring). In addition, a recess or recesses may be provided in the socket to enable more positive engagement of the socket when fully engaged on the drive portion.

In accordance with another embodiment of the present invention, I have invented an improved ratchet wrench for rotating a fastener. The ratchet wrench includes a handle having a head at one end thereof, the head having a cylindrical aperture formed therethrough centered on an axis. A drive member is mounted onto the handle and extends into the cylindrical aperture for rotation about the axis relative to the handle. The drive member is operably connected to a fastener so that rotation of the drive member rotates the fastener. The drive member further defines another aperture extending therethrough along the axis. This drive member has a drive portion with inner and outer surfaces extending along a common axis, the outer surface of the drive portion having a non-circular cross section perpendicular to the common axis and adapted for receiving a socket, and the inner surface of the drive portion having a non-circular cross section perpendicular to the common axis and adapted for receiving a socket. An elongated slot is formed through the inner and outer surfaces of the drive member. This elongated slot has opposite ends and at least one internal flange portion formed adjacent to the internal surface within the elongated slot such that a projection is formed at each end of the elongated slot. Opposed resilient members are mounted in the elongated slot facing opposite one another and held in place by deforming an edge against the ends of the resilient members. This edge is defined by the intersection of the outer surface and the elongated slot. This deforming operation effectively sandwiches the spring ends between the deformed edge and each projection while still allowing the middle portion of each spring to flex. Each opposed resilient member has a middle portion corresponding in shape to the elongated slot and having at least one protrusion which projects beyond the confines of the elongated slot, thereby enabling the protrusion to frictionally engage a socket by resiliently deflecting the protruding portion relative to the drive portion. For the same reasons stated above, the drive portion maintains its structural integrity as a cross section taken between the furthermost end of the elongated slot and the end of the drive portion yields a cross section of consistent thickness. In addition, the thickness of each spring is limited only by the thickness of the drive portion minus the sum of the thickness of the opposed spring, the thickness of the flange and the thickness of the deformed edge of the elongated slot. Although this embodiment does not allow each opposed spring to be as thick as compared with the embodiment utilizing a single s-shaped spring, each opposed spring reacts against the other thereby providing for a higher socket retention force than would be expected from a single thin spring.

The design of both the s-shaped and opposed resilient member permits ease of fabrication and subsequent installation in the elongated slot. Because of their simple form, these resilient members can be stamped using conventional methods with simple tooling. After fabrication, the spring or springs need only be placed within the confines of the slot and staked into place using a tool, such as a center punch, capable of deforming the outside edge of the elongated slot. At least two methods may be used in deforming the edge in order to sandwich the spring or springs in place. First, localized deformation can take place at the ends of the elongated slot. Localized deformation at the ends of the slot enables the spring or springs to have a uniform width if installed in a suitable elongated slot. Second, the entire edge of the elongated slot can be deformed. If this is done, the portion of the spring which protrudes beyond the slot and out of the drive portion may be required to have a reduced width (as compared to the spring ends) in order to avoid binding of the spring between the deformed edges.

In addition, the slot is relatively simple to manufacture. One method for making an elongated slot in which the resilient member can effectively function is to use a single end-mill tool of uniform size. A second method for producing the elongated slot is to use a stepped end-mill having two cutting diameters, the first to contact the drive portion in the cutting operation being the smaller diameter. A third method for producing the elongated slot is substantially the same as the second method except that instead of using one stepped end-mill, two end-mills of uniform but different diameters are used in two separate machining passes. Generally, the second and third method for generating the elongated slot result in a continuous lip or projection being formed adjacent to the inner surface of the drive portion and inside the elongated slot. This may effect the shape of a resilient spring (e.g. make it dog-bone shaped) in that the portion of a spring which protrudes into the aperture cannot be wider than the opening between the lips of the slot. A fourth method for producing the slot is through molding or casting the slot in place. This method significantly reduces or eliminates any secondary machining of the slot. Also, because of the shape of the slot—one which does not have any undercuts or blind cavities—a single mold insert can easily be fabricated to accomplish this end.

DESCRIPTION OF THE DRAWINGS

Other objects and advantages of this invention will become readily apparent as the same is better understood by reference to the following detailed description when considered in connection with the accompanying drawings wherein.

DETAILED DESCRIPTION

Figure 1:
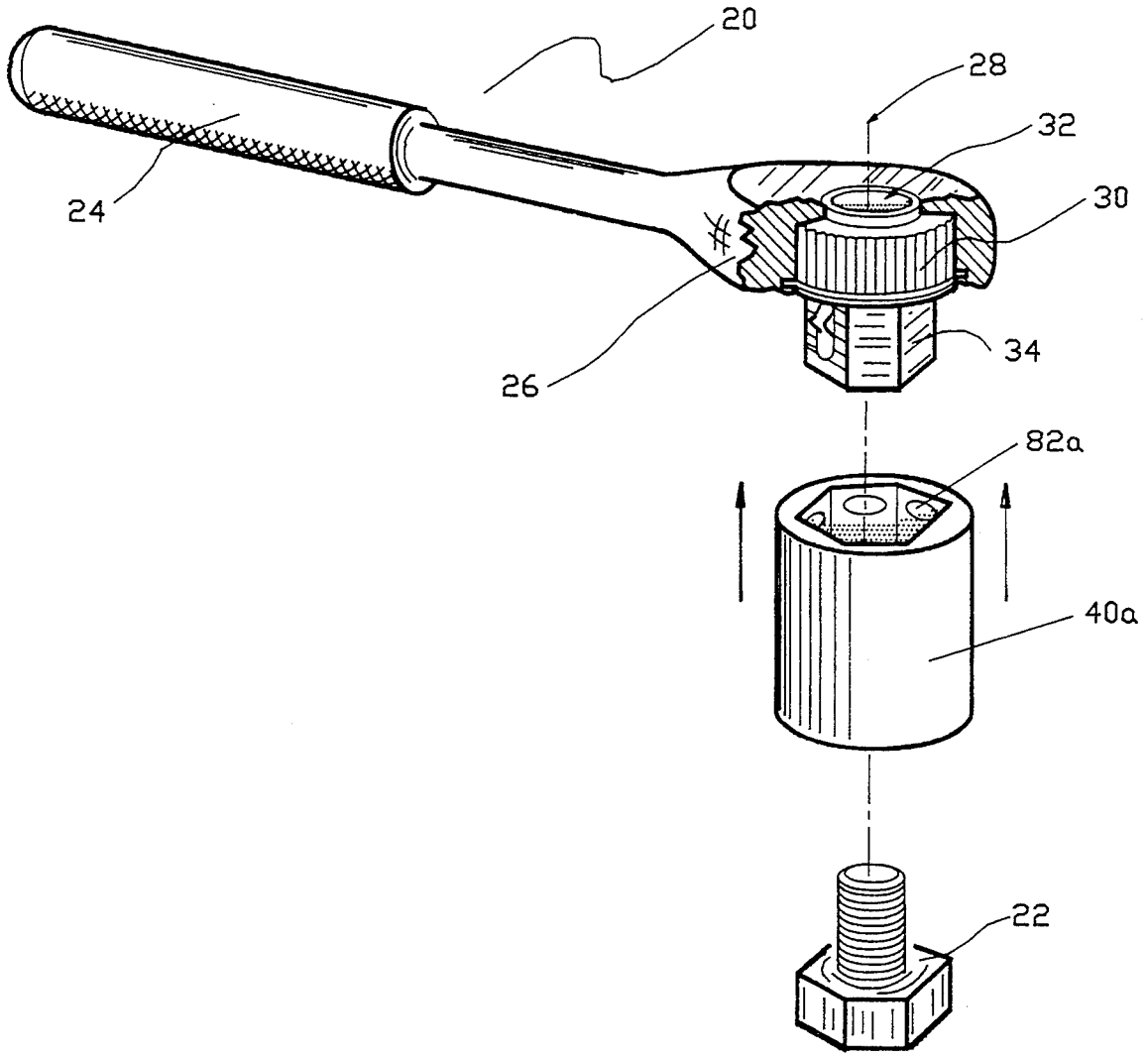
FIG. 1 shows a cutaway view of a ratchet wrench with a socket for rotating a fastener.
Figure 2A:
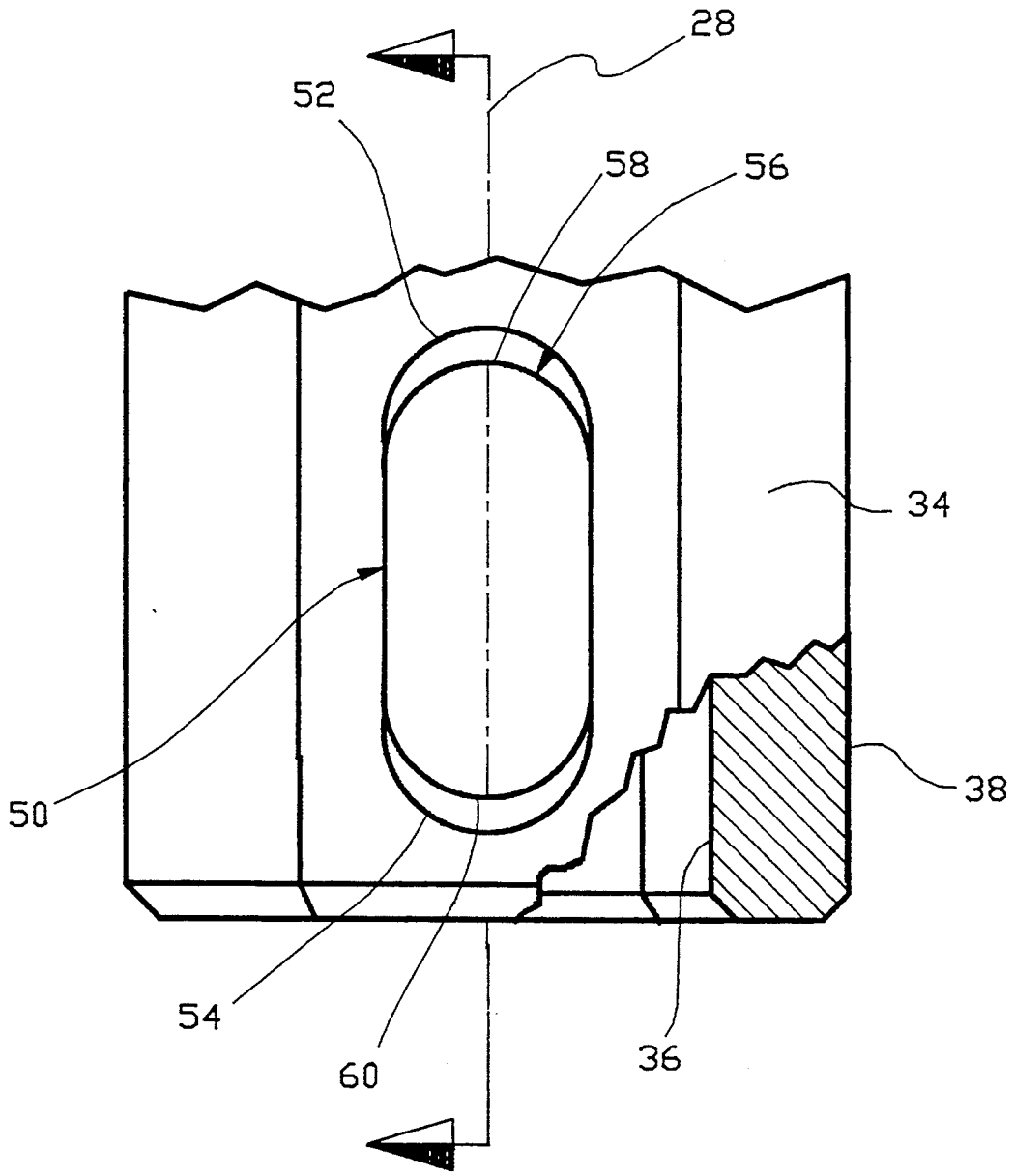
FIG. 2*a* shows a front view of the elongated slot in the drive portion of the drive member of the ratchet wrench.
Figure 2B:
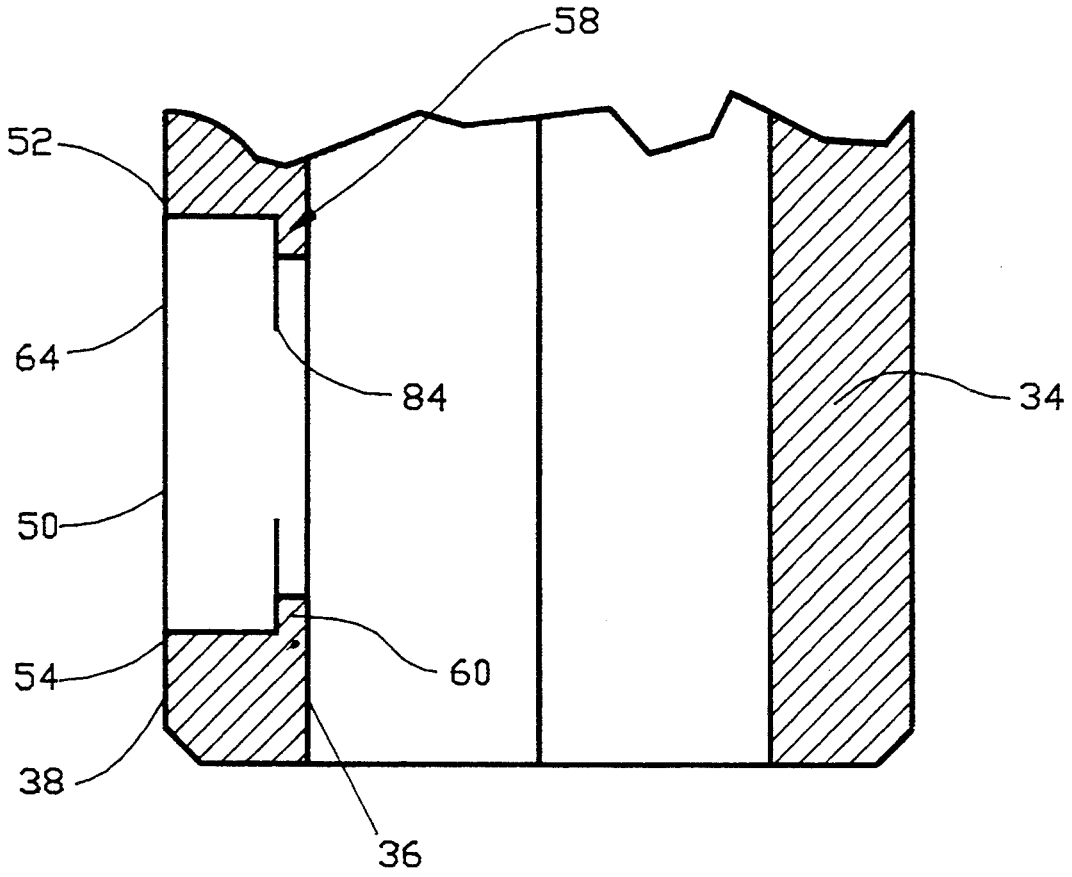
FIG. 2*b* shows a side cross sectional view of the elongated slot in the drive portion of the drive member of the ratchet wrench.

Referring now to the drawings wherein is shown preferred embodiments and wherein like reference numerals designate like elements throughout the several views, there is shown in FIG. 1 a cutaway view of a ratchet wrench 20 for rotating a fastener 22. The ratchet wrench includes a handle 24 having a head 26 at one end thereof, the head having a cylindrical aperture formed therethrough centered on an axis 28. A drive member 30 is mounted onto the handle and extends into the cylindrical aperture for rotation about the axis relative to the handle. The drive member is operably connected to the fastener so that rotation of the drive member rotates the fastener. The drive member further defines another aperture 32 extending therethrough along the axis. This drive member has a drive portion 34 with an inner surface 36 and an outer surface 38 extending along a common axis 28, the outer surface of the drive portion having a non-circular cross section perpendicular to the common axis and adapted for receiving a socket 40*a*, and the inner surface of the drive portion having a non-circular cross section perpendicular to the common axis and adapted for receiving a socket 40*b*, this socket being shown in the cross sectional view of FIG. 3*a*. An elongated slot 50 most clearly depicted in FIGS. 2*a* and 2*b* is formed through the inner and outer surfaces of the drive member. This elongated slot has opposite ends 52 and 54 and at least one internal flange portion 56 formed adjacent to the internal surface within the elongated slot such that a first and second projection 58 and 60 is formed at each end of the elongated slot.

Figure 3A:
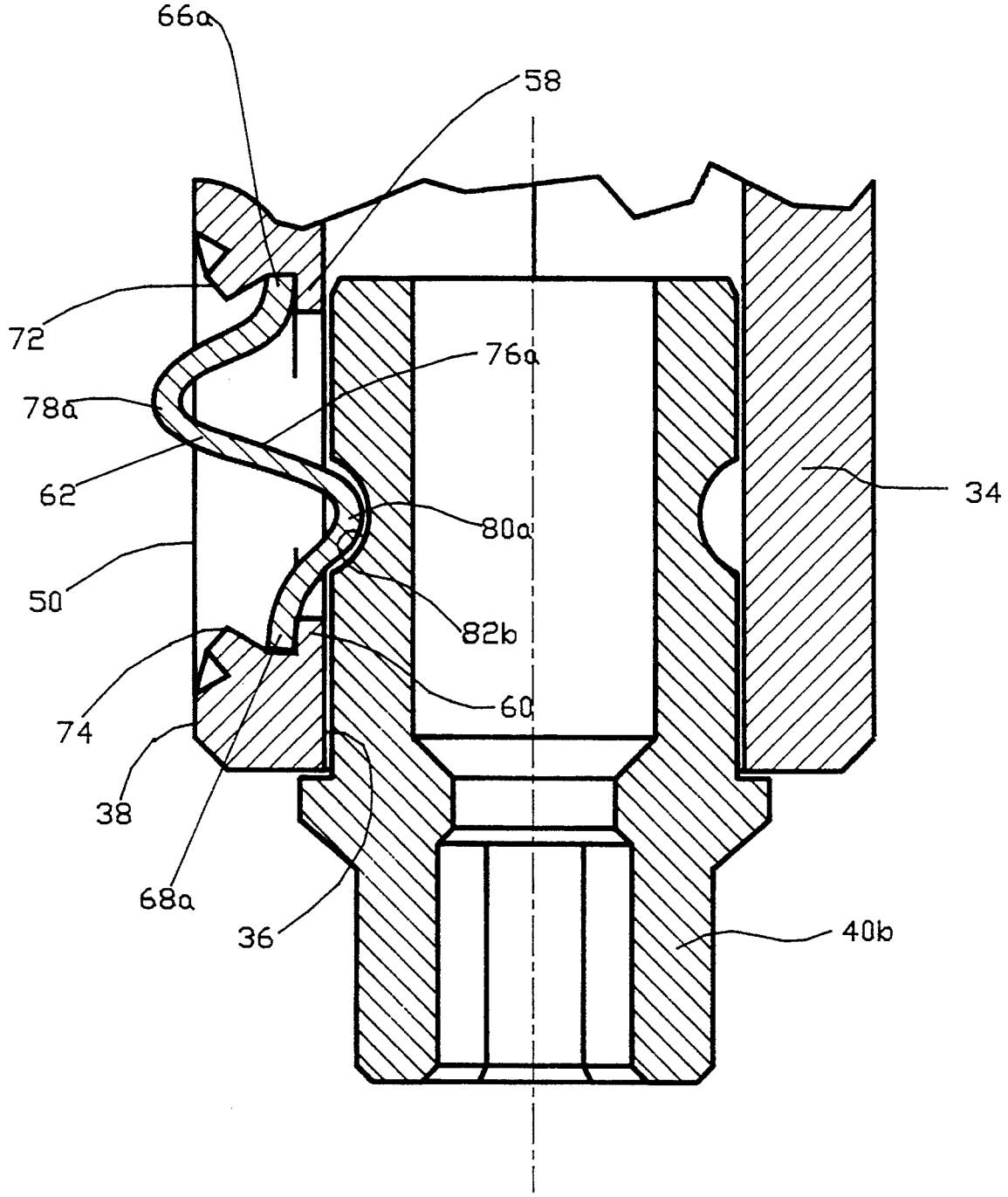
FIG. 3*a* shows a side cross sectional view of the elongated slot after installation of an s-shaped spring in the slot and with a socket inserted into the drive portion of the ratchet wrench according to the teachings of the first embodiment of the invention.
Figure 3B:
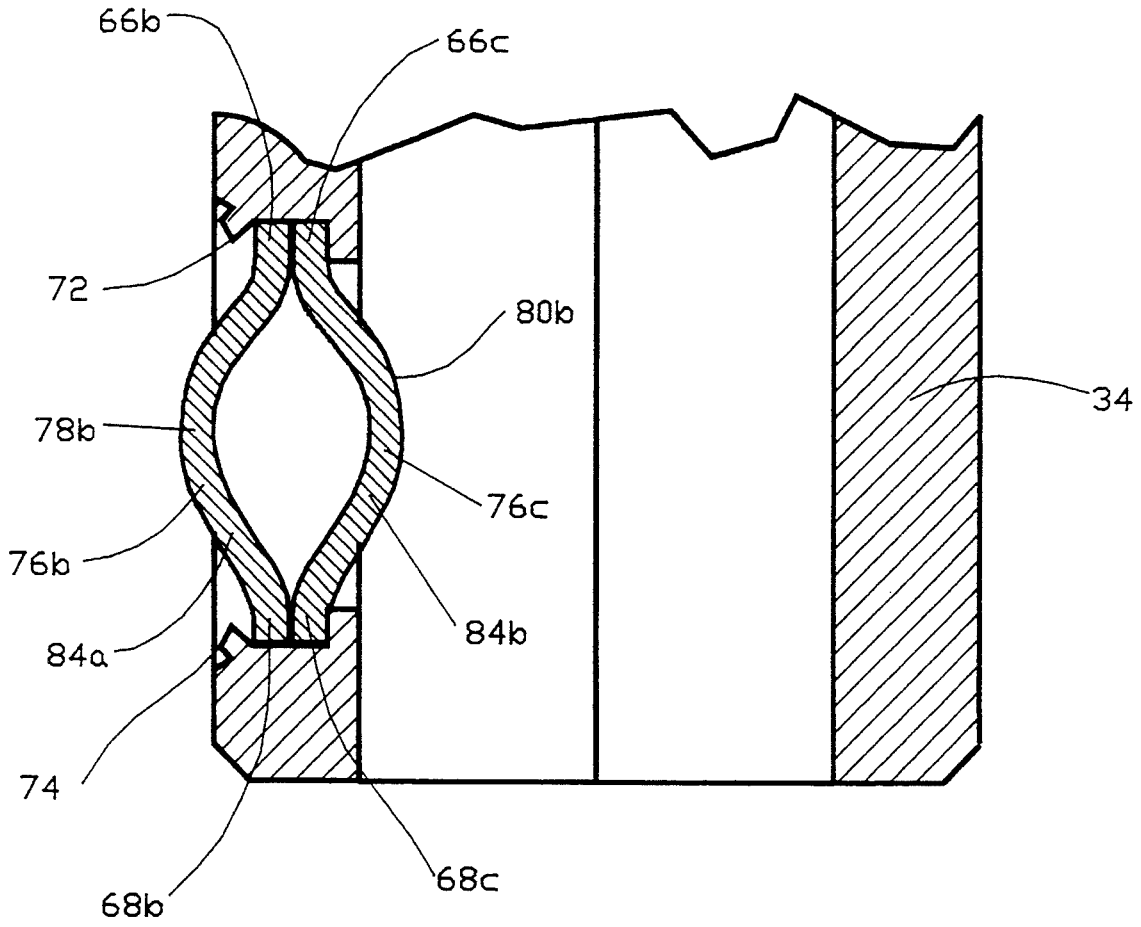
FIG. 3*b* shows a side cross sectional view of the elongated slot after installation of two opposed resilient members according to the teachings of the second embodiment of the invention.
Figure 3C:
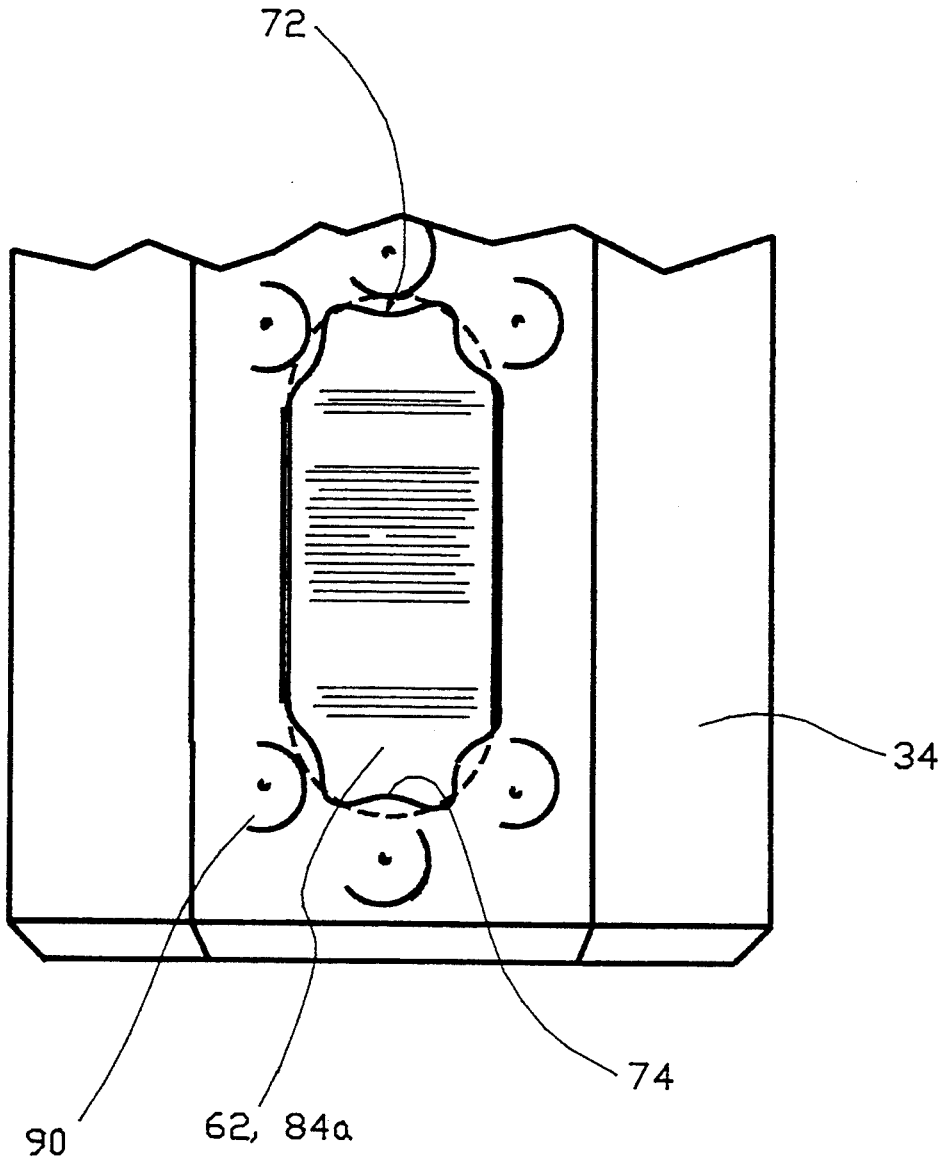
FIG. 3*c* shows a front view of the elongated slot after installation of the resilient member or members and deformation of the edge of the slot.

In accordance with one embodiment of the present invention as depicted in FIGS. 3*a* and 3*c*, a resilient s-shaped spring 62 formed from flat spring material is disposed within the elongated slot and is held in place by deforming an edge 64 against the first and second end 66*a* and 68*a* of the resilient spring. This edge is defined by the intersection of the outer surface and the elongated slot. This deformation effectively sandwiches the spring ends between each deformed edge 72 and 74 and each projection while still allowing the middle portion 76*a* of the spring to flex. Curved portions 78*a* and 80*a* of the s-shaped spring are sized to protrude beyond the elongated slot and either into the aperture 32 or out of the drive member such that a socket will necessarily deflect the corresponding wave of the s-shaped spring when fully engaged on the drive portion. This deflection of the resilient spring enables the frictional retention of the socket on the drive member. At least one recess 82*a* or 82*b* may be provided in a socket to more positively engage the socket when the socket is fully engaged on the drive portion. Furthermore, the thickness of the spring is substantial in that it need not wrap around the drive member and therefore does not locally increase the width of the drive portion or create a structurally weak region in the drive portion as is evident by taking a cross section through the drive member in an area between the furthermost end of the elongated slot and the end of the drive portion (the drive portion remains of consistent thickness). The thickness of the spring is limited only by the thickness of the drive portion minus the sum of the thickness of the flange and the thickness of the deformed edge of the elongated slot.

In accordance with another embodiment of the present invention as depicted in FIG. 3*b* and 3*c*, opposed resilient members 84*a* and 84*b* formed from flat spring material are mounted in the elongated slot facing opposite one another and held in place by deforming an edge 64 against the ends 66*b*, 66*c*, 68*b*, and 68*c* of the resilient members. This edge is defined by the intersection of the outer surface of the drive portion and the elongated slot. This deformation effectively sandwiches the spring ends between each deformed edge 72 and 74 and each projection while still allowing the middle portion of each spring to flex. Each opposed resilient member has a middle portion 76*b* and 76*c* corresponding in shape to the elongated slot and having at least one protrusion 78*b* and 8O*b* which projects beyond the confines of the elongated slot, thereby enabling the protrusion to frictionally engage a socket by resiliently deflecting the protruding portion relative to the drive portion. For the same reasons stated above, the drive portion maintains structural integrity as a cross section taken between the furthermost end of the elongated slot and the end of the drive portion has a consistent thickness. Furthermore, the thickness of each spring is limited only by the thickness of the drive portion minus the sum of the thickness of the opposed spring, the thickness of the flange and the thickness of the deformed edge of the elongated slot. Therefore, the use of the opposed resilient members reduces the maximum thickness permissible for each opposed resilient member as compared to the use of a single s-shaped resilient member above (by an amount equal to the thickness of the opposed resilient member). However, because the two opposed resilient members are sandwiched together, they are able to react against one another thereby significantly increasing the resistance of the assembly to deflection and therefore the force with which it can retain a socket.

The design of the resilient member permits ease of fabrication from a suitable spring material such as high-carbon steel and ease of installation in the elongated slot. A simple stamping operation is all that is necessary to form the s-shaped spring or either of the opposed springs. For assembly in the elongated slot, the spring or springs need only be installed within the confines of the slot and staked into place using a tool, such as a center punch, capable of deforming the outside edge of the elongated slot. At least two deformation methods may be used in deforming the edge in order to sandwich the spring or springs in place. The first deformation method results in an assembly generally as shown in FIG. 3*c*. In this method, the ends of the elongated slot are locally deformed using a suitable tool such as a center punch which results in a plurality of dimples 90, or a special punch which corresponds in shape to the edge to be deformed. Localized deformation at the ends of the slot enables the spring to have a uniform. width which corresponds to the width of the middle portion of the slot as shown in FIGS. 2*a* and 3*c*. In the second method, the entire edge of the elongated slot is deformed. If this is done, the width of the portion of the spring which protrudes beyond the slot and out of the drive portion must be reduced (as compared to the width of the spring ends) in order to avoid the binding of the spring between the deformed edges. Furthermore, it should be noted that in both methods of deforming the edge over the ends of the spring or springs, it is not necessary that the ends be held such that they cannot move in the slot. The deformation of the edge is only meant to prevent lateral movement of the spring or springs relative to the axis 28 and to retain the spring or springs within the elongated slot, particularly when the spring or springs are deflected by a socket. Other methods, though not preferred, are contemplated as being effective for securing the spring or springs in the elongated slot. These include spot welding, fastening with rivets or screws, or brazing.

In addition, the elongated slot is relatively simple to manufacture. A first method for making the elongated slot of the configuration as described in FIGS. 2*a* and 2*b*, is to use a single end-mill tool of uniform size. The end-mill tool can be plunged into the drive portion of the drive member in a direction perpendicular to its outer surface, then stopped before exiting through the inner surface, redirected to travel a distance along the length of the drive portion and parallel with the axis 28 of the aperture in the drive member, stopped again, redirected to break through the inner surface of the drive portion, stopped, redirected to continue along the length of the drive portion thereby creating a slot through the drive portion, stopped, redirected to partially back out of the slot so created, stopped, redirected to continue along the length of the drive portion, stopped, and backed out of the resulting elongated slot. An alternative using the same end-mill of uniform size would involve taking two passes, the first creating a larger blind slot and the second breaking through the thin wall of the drive portion and creating a slot of lesser length than the first and centered within the larger slot.

A second method for producing the elongated slot is to use a stepped end-mill having two cutting diameters, the first to contact the drive portion in the cutting operation being the smaller diameter. This stepped end-mill tool can be plunged into the drive portion in a direction perpendicular to its outer surface until just before the second larger diameter exits through the inner surface, then stopped, redirected along the length of the drive portion and parallel with the axis 28, stopped again and backed out of the slot so created.

A third method for producing the elongated slot is substantially the same as the second method except that instead of using one stepped end-mill, two end-mills of uniform diameter are used in two separate passes. Generally, the second and third method for generating the elongated slot result in a continuous lip or projection being formed adjacent to the inner surface of the drive portion and inside the elongated slot. This may effect the shape of a resilient spring (e.g. make it dog-bone shaped) in that the portion of a spring which protrudes into the aperture cannot be wider than the opening between the lips of the slot.

A fourth method for producing the slot is through casting or molding the slot in place thereby significantly reducing or eliminating any secondary machining of the slot completely. Because of the shape of the slot, one which does not have any undercuts or blind cavities, a single mold insert can easily be fabricated to accomplish this end.

Although the present invention has been described in considerable detail with reference to certain preferred versions thereof, other versions are possible. For example, the elongated slot may have squared ends or some shape other than the rounded ends depicted in the drawings. The ratchet wrench described herein may have other additional features common to ratchet wrenches such as reversibility, fine-tooth ratchet action, a thumbwheel and the like. Also, other shapes for the resilient members are possible besides the s-shaped and bowed shapes described herein. Therefore, the spirit and scope of the appended claims should not be limited to the description of the preferred versions contained herein.

I claim:

1. A spring retainer system for use in a ratchet wrench assembly of the type having a handle with a head at one end thereof and a drive member rotatably engaged in the head and having a drive portion for slidably receiving and rotating a socket to install or remove a fastener, said spring retaining system comprising:

a drive member having one end adapted to be received in and engaged with the head to rotate therewith as a unit in a clockwise or counterclockwise direction about an axis of rotation for transmitting torque while allowing relative rotation in the opposite direction, and an inner socket receiving portion and a coaxial outer socket receiving portion defining a drive portion of non-circular cross section configured to slidably receive a socket on either said inner or said outer socket receiving portion;

an elongated slot formed transversely through the wall of said drive portion; and retaining spring means mounted in said elongated slot and having top and bottom ends secured at the top and bottom ends, respectively, of said slot and an intermediate portion with at least two protrusions, at least one of which is resiliently biased to protrude into said inner socket receiving portion, and at least one of which is resiliently biased to protrude outward from said outer socket receiving portion to frictionally engage and retain a socket on either said inner or said outer socket receiving portion when slidably received thereon.

2. A spring retainer system according to claim 1 in which said retaining spring means comprises a resilient spring member with a generally S-shaped intermediate portion having a first curved portion which protrudes into said inner socket receiving portion and a second curved portion which protrudes outwardly from said outer socket receiving portion.

3. A spring retainer system according to claim 1 in which said retaining spring means comprises an inner and outer resilient member with opposed generally C-shaped intermediate portions, said inner resilient member having a curved portion which protrudes into said inner socket receiving portion and said outer resilient member having a curved portion which protrudes outwardly from said outer socket receiving portion.

4. A wrench assembly for receiving a socket to rotate a fastener, comprising:

a handle having a head at one end thereof;

a drive member rotatably mounted on said head and engaged therewith to rotate together as a unit in a clockwise or counterclockwise direction about an axis of rotation for transmitting torque while allowing relative rotation in the opposite direction;

said drive member having an inner socket receiving portion and a coaxial outer socket receiving portion defining a drive portion of non-circular cross section configured to slidably receive a socket on either said inner or said outer socket receiving portion; and an elongated slot having top and bottom ends formed transversely in the wall of said drive portion, said elongated slot having opposed projections at the top and bottom ends of said slot adjacent said inner socket receiving portion and opposed projections at the top and bottom ends of said slot adjacent said outer socket receiving portion; and retaining spring means mounted in said elongated slot and having top and bottom ends secured between opposed projections at the top and bottom ends, respectively, of said slot, and said spring means having an intermediate portion with at least two protrusions, at least one of which is resiliently biased to protrude into said inner socket receiving portion, and at least one of which is resiliently biased to protrude outward from said outer socket receiving portion to frictionally engage and retain a socket on either said inner or said outer socket receiving portion when slidably received thereon.

5. A wrench assembly according to claim 4 in which said retaining spring means has a generally S-shaped intermediate portion with a first curved portion which protrudes into said inner socket receiving portion and a second curved portion which protrudes outwardly from said outer socket receiving portion.

6. A wrench assembly according to claim 4 in which said retaining spring means comprises an inner and outer spring member with opposed generally C-shaped intermediate portions, said inner spring member having a curved portion which protrudes into said inner socket receiving portion and said outer spring member having a curved portion which protrudes outwardly from said outer socket receiving portion.

7. A socket retainer assembly for a thin-wall drive portion of a wrench, said assembly produced by a process for installing resilient socket retaining means in the drive portion of a drive member of a wrench having an inner and outer socket receiving portion, said process comprising the steps of:

(a) forming an elongated slot having top and bottom ends transversely in the wall of said drive portion;

(b) creating opposed projections at the top and bottom ends of said slot adjacent the inner socket receiving portion;

(c) placing resilient retaining spring means in said elongated slot, said retaining spring means having top and bottom ends which are engaged against said opposed projections, and an intermediate portion with at least two protrusions, at least one protrusion protruding laterally with respect to each socket receiving portion; and (d) securing said top and bottom ends of said retaining spring means in place such that at least one of said protrusions is resiliently biased to protrude laterally inward with respect to said inner socket receiving portion and at least one other of said protrusions is resiliently biased to protrude laterally outward with respect to said outer socket receiving portion in order to frictionally engage and retain a socket when slidably received thereon.

8. The socket retainer assembly according to claim 7, in which a second set of opposed projections are created at the top and bottom ends of said slot adjacent to the outer socket receiving portions, and in which said retaining spring means is secured between said opposed projections within said slot.

9. The socket retainer assembly according to claim 7 in which said steps of forming said elongated slot and said opposed projections comprise (a) machining a first elongated slot transversely in the drive portion which does not penetrate entirely through the wall of the drive portion, and (b) machining a coaxial second slot of lesser length than the first slot which breaks through the wall of the drive portion to form said projections at opposite ends of said slot.

10. The socket retainer assembly according to claim 7 in which said steps of forming said elongated slot and creating said opposed projections comprise simultaneously machining a first elongated slot and coaxially second slot of lesser length than the first slot transversely in the wall of the drive portion such that only the second slot penetrates entirely through the wall of the drive portion and the difference in the lengths of the slots thus formed define said opposed projections.

11. The socket retainer assembly according to claim 7 in which said steps of forming said elongated slot and creating said opposed projections comprise casting the drive member to provide a first elongated slot and a coaxial second slot of lesser length than the first slot which extends transversely into the wall of the drive portion with only the second slot penetrating entirely through the wall of the drive portion and the difference in the vertical lengths of the slots thus formed defining said opposed projections.

12. The socket retainer assembly according to claim 7 in which the drive member has an inner socket receiving portion and a coaxial outer socket receiving portion defining a drive portion of non-circular cross section configured to slidably receive a socket on either said inner or said outer socket receiving portion.

13. A socket retainer assembly for a thin-wall drive portion of the drive member of a wrench, said drive member having an inner socket receiving portion and a coaxial outer socket receiving portion defining a drive portion of non-circular cross section configured to slidably receive a socket on either said inner or said outer socket receiving portion, said socket retainer assembly being produced by a process comprising the steps of:

(a) forming an elongated slot having top and bottom ends transversely in the wall of said drive portion;

(b) creating opposed projections at the top and bottom ends of said slot adjacent the inner socket receiving portion;

(c) installing resilient retaining spring means in said elongated slot, said retaining spring means having top and bottom ends which are engaged against said opposed projections, and an intermediate portion with at least two protrusions, at least one protrusion protruding laterally with respect to each socket receiving portion; and (d) deforming the outside edge of said slot against said top and bottom ends of said spring means such that at least one of said protrusions is resiliently biased to protrude into said inner socket receiving portion, and at least one other one of said protrusions is resiliently biased to protrude outward from said outer socket receiving portion to frictionally engage and retain a socket on either said inner or said outer socket receiving portion when slidably received thereon.

14. The socket retainer assembly according to claim 13 in which said steps of forming said elongated slot and said opposed projections comprise (a) machining a first elongated slot transversely in the drive portion which does not penetrate entirely through the wall of the drive portion, and (b) machining a coaxial second slot of lesser length than the first slot which breaks through the wall of the drive portion to form said projections at opposite ends of said slot.

15. The socket retainer assembly according to claim 13 in which said steps of forming said elongated slot and said opposed projections comprise simultaneously machining a first elongated slot and a coaxial second slot of lesser length than the first slot transversely in the wall of the drive portion such that only the second slot penetrates entirely through the wall of the drive portion and the difference in the lengths of the slots thus formed define said opposed projections.

16. The socket retainer assembly according to claim 13 in which said steps of forming said elongated slot and said opposed projections comprise casting the drive member to provide a first elongated slot and a coaxial second slot of lesser length than the first slot which extends transversely into the wall of the drive portion with only the second slot penetrating entirely through the wall of the drive portion and the difference in the vertical lengths of the slots thus formed defining said opposed projections.

17. The socket retainer assembly according to claim 13 in which said retaining spring means has a generally S-shaped intermediate portion with a first curved portion which protrudes into said inner socket receiving portion and a second curved portion which protrudes outwardly from said outer socket receiving portion.

18. The socket retainer assembly according to claim 13 in which said retainer spring means comprises an inner and outer spring member with opposed generally C-shaped intermediate portions, said inner spring member having a curved portion which protrudes into said inner socket receiving portion and said outer spring member having a curved portion which protrudes outwardly from said outer socket receiving portion.

* * * * *